United States Patent [19]

Vallerga

[11] Patent Number: 4,783,978

[45] Date of Patent: Nov. 15, 1988

[54] SAFETY LOCK FOR SECURITY POUCHES

[76] Inventor: Jose A. Vallerga, Castanón No. 1347, 1406 Buenos Aires, Argentina

[21] Appl. No.: 58,133

[22] Filed: Jun. 4, 1987

[30] Foreign Application Priority Data

Jun. 20, 1986 [UY] Uruguay ..... 752833

[51] Int. Cl.[4] ..... E05B 65/52

[52] U.S. Cl. ..... 70/65; 383/86.2; 150/123

[58] Field of Search ..... 70/65, 66, 64; 24/30.5 R; 150/118, 120, 121, 122, 123, 124, 130; 383/84, 86.1, 86.2, 87, 91, 92, 120, 121

[56] References Cited

U.S. PATENT DOCUMENTS 229,358 6/1880 Bennett et al. ..... 383/86.1

598,139 2/1898 Doyle ..... 383/86.2

4,175,604 11/1979 Bonner ..... 70/65

*Primary Examiner*—Robert L. Wolfe

*Attorney, Agent, or Firm*—Kuhn and Muller

[57] ABSTRACT

A safety lock for security pouches is provided which includes a bolt member secured at one end to a back wall of the pouch which extends inwardly across the mouth of the pouch, a front wall of the pouch having an opening therethrough to receive the bolt member, articulated opposite reinforced side walls which are adapted as inwardly extending lateral pleats between the front and back walls of the pouch and have openings to receive the bolt member extending between the front and back walls, and a rigid flap which extends from the top of the back wall and unfolds the closed mouth of the pouch and a portion of the front wall and has an opening therethrough to receive the bolt member.

9 Claims, 6 Drawing Sheets

12
13
13'
14
10
3
11
9
28
26
20
19
29'
2
33
35
18
15
14
10
14
16
17
7
6
5
9
12A
25
12
13'
13
17
3
4

SAFETY LOCK FOR SECURITY POUCHES

FIELD OF THE INVENTION

The present invention relates to pouches of the type used to transport valuables or securities; and more particularly the invention is to provide a lock which is safe and tamper proof, easy to operate and reduces the time needed for loading and unloading of the pouches.

BACKGROUND OF THE INVENTION

Valuables and/or important documents are transported in pouches or bags with locks which are not always adequate for purposes of the security required for the transfer of such items. The natural and indispensable component of a lock system is security, which will assure inviolability or will provide evidence of tampering if an attempt was made to reach the contents of the pouch.

Pouches containing valuables such as jewels, large sums of currency, important documents or the like are frequently transported under the responsibility of persons in charge of the transfer, and it is sometimes necessary to do so in several stages until the pouch reaches its destination. At each stage, the recipient must sign to acknowledge responsibility, and in spite of the zeal of the custodians and couriers, it has happened that losses, particularly of money, have occurred without any sign of tampering with a safety belt or similar means for locking the pouch. This anomaly is the direct consequence of a deficiency in the locks, for it has been shown that access to the contents is possible through gaps in the expansion folds for opening of the securities pouch which the safety strap cannot close.

Under these circumstances, the person responsible for receiving the pouch and then passing it on, when he finds that the strap has not been tampered with and the pouch has no cuts hidden in the folds of the opening or anywhere else, acknowledges in good faith for proper reception, and the pouch continues on its way to its final destination where the loss is found when the valuables or securities are checked. These in summary are the failings of pouches or bags for securities which have been repeatedly evidenced by companies which transport valuables, banks, credit institutions, etc., and which this invention is intended to remedy.

SUMMARY OF THE INVENTION

In accordance with the present invention, a pouch is provided having safety lock means which is characterized by the pouch having a rigid shape for its flat open end which extends across the front and back, and with flexible sides which can be overlapped. The locking action produces an articular retractible movement which automatically shapes the flexible sides and accommodates them between the front and the back, and this unit is then covered by a flap, which can be reinforced, and which in turn is, preferably, held in its attachment and pressed in by two belts that can be closed; which are longitudinal extensions of the back. A grooved bolt in which a strap or padlock is fitted, traverses the locking system and finally confines all the parts of the pouch which work together and overlap, when the safety belt or padlock is attached. The mouth of the pouch has a rigid perimter in which the front and back walls are fixed and the opposing sides walls therebetween are jointed and which, with the action of closing the mouth, automatically produce and accommodate the pleats. In this way, when the pouch is open, the mouth takes on the general shape of a parallelogram, which is the ideal shape for packing the items to be transported, as it permits easy operation without difficulty.

This type of mouth also allows the pouch to hang on frames or shelves, so that a plurality of pouches, a receiving battery, is formed, of which they form divisions or boxes.

The action of hanging the pouch and the characteristics of its construction, cause the mouth to open automatically through the force of gravity, once the belts and the flap have been loosened; the resulting incline is appropriate for easy and convenient packing, and for unhooking and closing and belting. The pouch may be packed while hanging from a hook on the wall, or lying on the ground, or, if preferred, on a table or desk at a more convenient height. The shape of the pouch in no way affects the possibility of packing it, but hanging it makes this most convenient.

The mouth of the pouch has a rigid, fixed front wall along its full length which has in its center an opening formed by an eyelet. The back wall is flexible and has, generally in the center aligned with the opening in the front wall, a reinforced metal element on which is mounted a bolt extending inwardly from the back wall which has a groove transversely located near the protruding end and through which, once the pouch is closed, the safety belt and/or padlock can be placed. This reinforced metal element on the back wall supports the grooved belt and faces it inside the pouch across the mouth or open end of the pouch in the direction towards the opening in the rigid front wall. Further, the flexible back wall is extended into a flap which is rigid throughout, because a tempered steel plate is sheathed thereby.

The opposing side walls of the pouch have four tempered steel strips inserted and sheathed in the upper part which forms the mouth, two on each side which, together with those in the front and on the flap, provide the necessary rigidity for this type of lock. The arrangement and dimensions of the same produce articulation in the area of the mouth when the pouch is closed, resulting in an automatic retractible movement which arranges the folds and accommodates them towards the inside of the pouch, in a position parallel to the front and back.

The place where the side walls are folded over, is wide enough so that as the mouth of the pouch is closed with both side walls oriented along a line of the mouth, the grooved bolt in the center pierces them together with the front wall portion of the pouch. Therefore, the pleats are automatically accommodated and confined between the front and back.

The flap, which is an extension of the back wall of the pouch, also has on the inside a stiffening member made of a tempered steel strip with an eyelet in the middle which is aligned with the grooved bolt and is pierced by it when the flap is closed over the mouth of the pouch.

Preferably, the locking system is completed by two strips or belts which are longitudinal extensions of the back wall, one on each side, in the area of the other extension which forms the flap. These belts are long enough to close about and put pressure on the upper edges of the pouch in an encircling action and have one or more openings or eyelets in each end thereof. The pressure caused when the two belts are extended by force so as to accommodate the eyelets therein about the central grooved belt, after accommodating the safety strap, juxtaposes and rigidly confines all the parts gathered and pierced by the central bolt, preventing possible creases or displacement of the pouch walls. This reduces a possible theft, since creases in the walls produce gaps through which the contents of the pouch would be accessible unless rigidly confined as in the instant pouch.

The above described locking system has two determining characteristics. The first is that with a single bolt, all the functional parts working together can be easily and quickly confined, resulting in the smooth formation of the area adjacent to the closed mouth, which is important for finding possible hidden cuts during an inspection before opening of the pouch when the valuables are being received. The second is that the advancing movement of the bolt secured to the back wall toward the front wall of the pouch produces a displacement action of the articulated sides, which thus form and accommodate both folds automatically. Therefore, the operations of packing and unpacking are easily done, thus noticeably shortening the time normally required, which in general is subject to a strict schedule.

It is also important that a pouch with this type of lock can withstand any accidental mishandling due to operational service, for it has no element that can be damaged, preventing its normal use.

BRIEF DESCRIPTION OF THE DRAWINGS

In its essential aspect and shape therefore, the safety lock for pouches for valuables has been characterized and for the purposes of improving this description and making other objects, features and advantages thereof more readily apparent it will be described in detail below with reference to a preferred embodiment thereof illustrated in the accompanying drawings in which.

DESCRIPTION OF THE PREFERRED EMBODIMENTS

Figure 1:
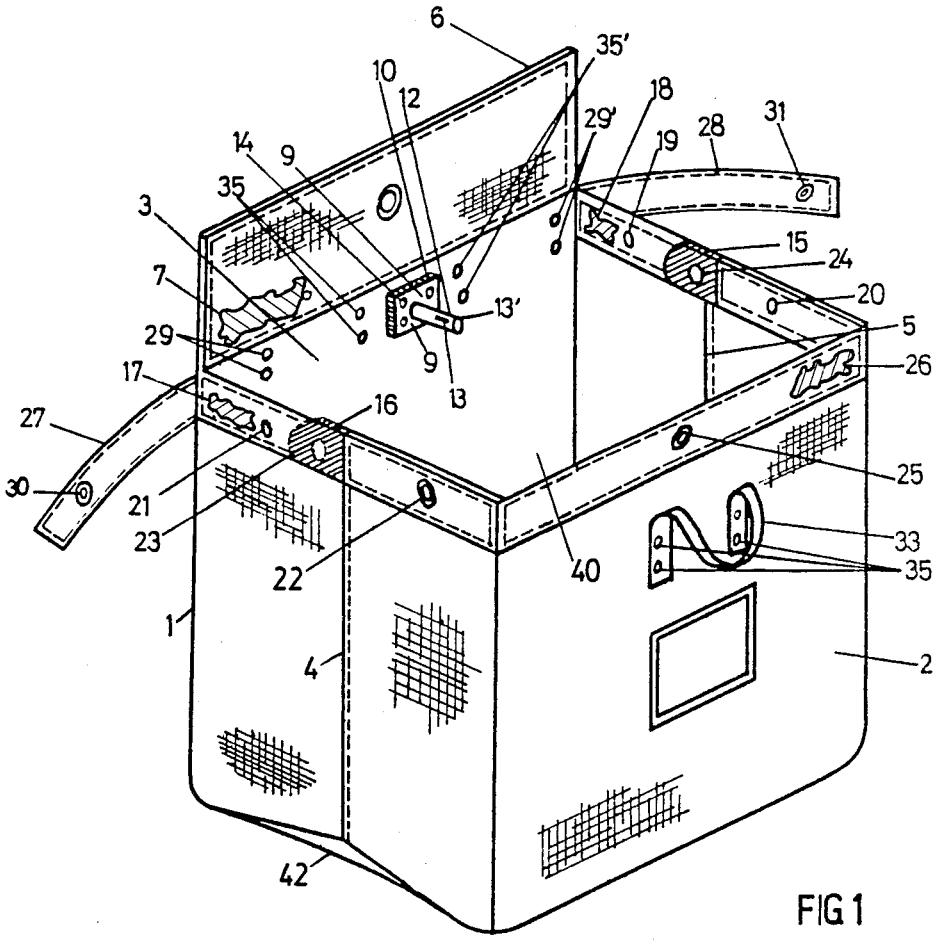
FIG. 1 is a front view, in perspective, of the pouch of the invention with the mouth open, showing its rigid, generally parallelogram shape when it is opened.
Figure 2:
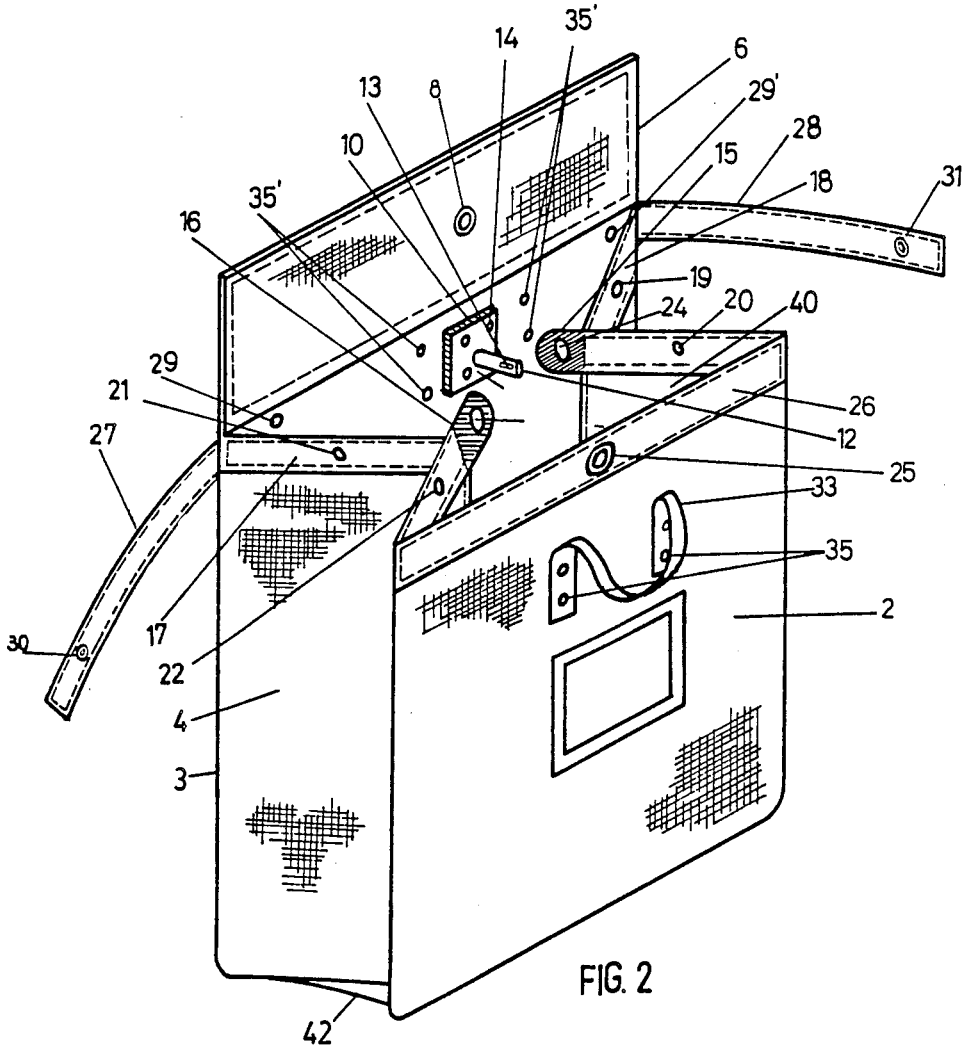
FIG. 2 is a front view, in perspective, of the pouch of FIG. 1 showing that approaching from back to front, in the natural action of the closing of the mouth, an articular retractible movement occurs on the side walls which forms and accommodates the pleats bringing together openings in the opposite side walls of the pouch in the direction of a grooved bolt member which pierces them in its movement toward the front wall.

In all these drawings, the same reference numerals are used for the same or corresponding parts. As can be seen from these drawings, the pouch 1 with the safety lock of the invention has a cloth fabric body with a front wall 2 and a back wall 3, which can be juxtaposed so as to achieve lateral pleats or side walls 4 and 5 of the pouch, and a bottom wall 42. In the mouth 40 of the pouch, the rear wall 3 is extended into a flap 6 of the same length which has internal reinforcement to give it rigidity, composed of a tempered steel strip 7. The flap 6 has an opening 8 in the middle formed by an eyelet which binds the cloth with the steel strip 7.

Figures 7, 8:
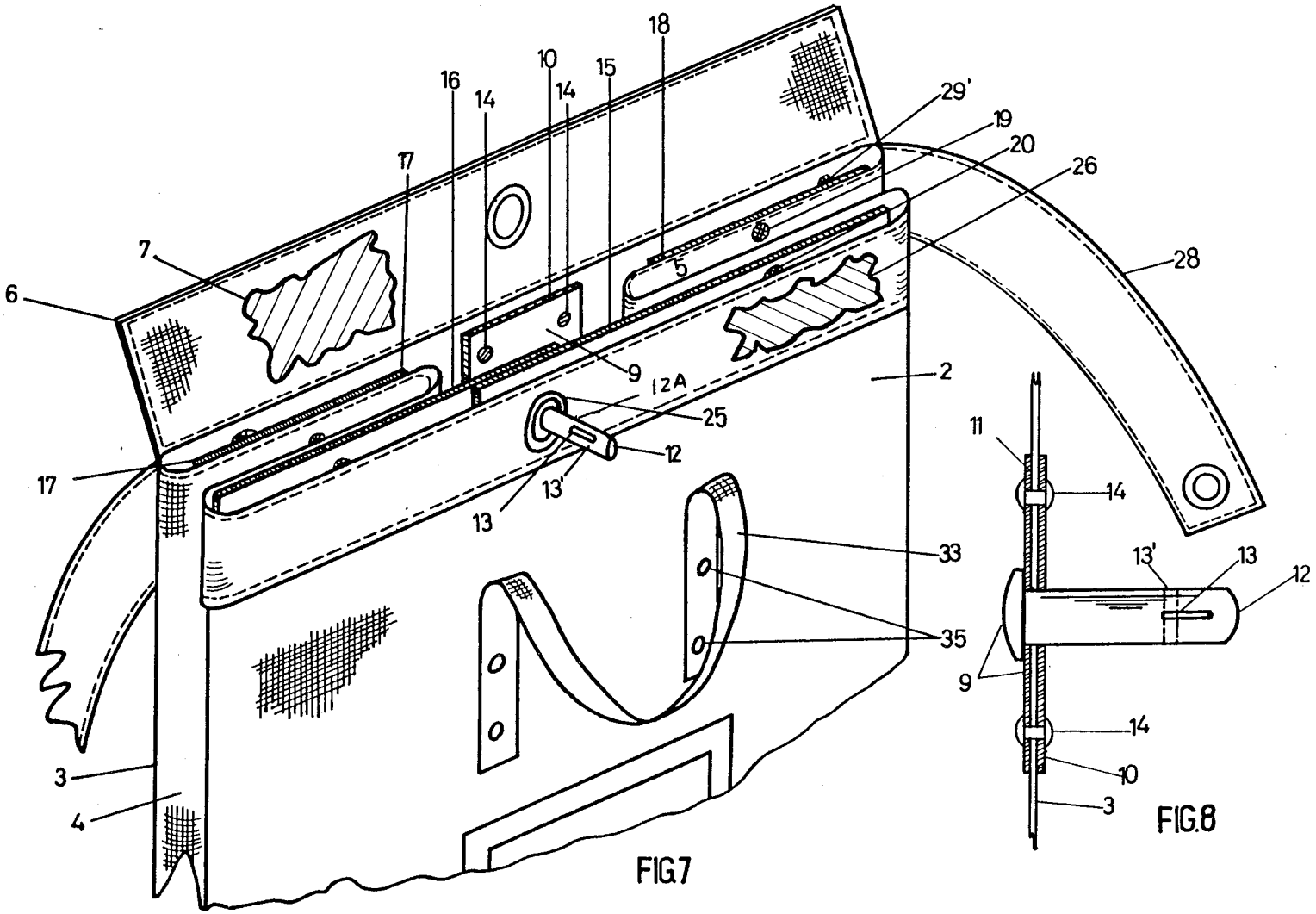
FIG. 7 is an enlarged perspective view, part broken away and part in section, of the pouch in the partially closed position shown in FIG. 3.
FIG. 8 is a partial cross-sectio view of the components and attachment to the back wall of the pouch of the metal unit bearing the bolt member.

Adjacent the upper edge of back wall 3, a metal element 9 is attached substantially in the middle of the upper part of the wall, composed of two plates 10 and plate 11, with plate 11 bearing a bolt 12 which near its protruding end 12A has a groove for the opening 13 for receiving a belt, and an opening 13' with a diameter for accommodating a padlock, if desired, as an alternative for locking the pouch (FIG. 8). Plate 11 is affixed on the outside surface of the back wall 3 of the pouch with plate 10 on the inside surface of the back wall 3, on a coinciding line, and attached so as to pinch therebetween the fabric of the back wall 3 by means of four rivets 14. The action of closing the mouth 40 produces a retractible displacement movement of the retaining side walls 4 and 5 having the tempered steel plates 15, 16, 17 and 18 inserted in the upper portions thereof and attached to them by rivets 19, 20, 21 and 22. The ends of steel plates 15 and 16 extend beyond the side walls 4 and 5 and have openings 23 and 24 respectively in such extended ends. In advancing the back wall 3 towards the front wall 2, bolt 12 is aligned with the openings 23 and 24 and then at the end of the movement, it is introduced into opening 25 of steel strip 26 secured along the upper part of the front wall 2.

Figure 4:
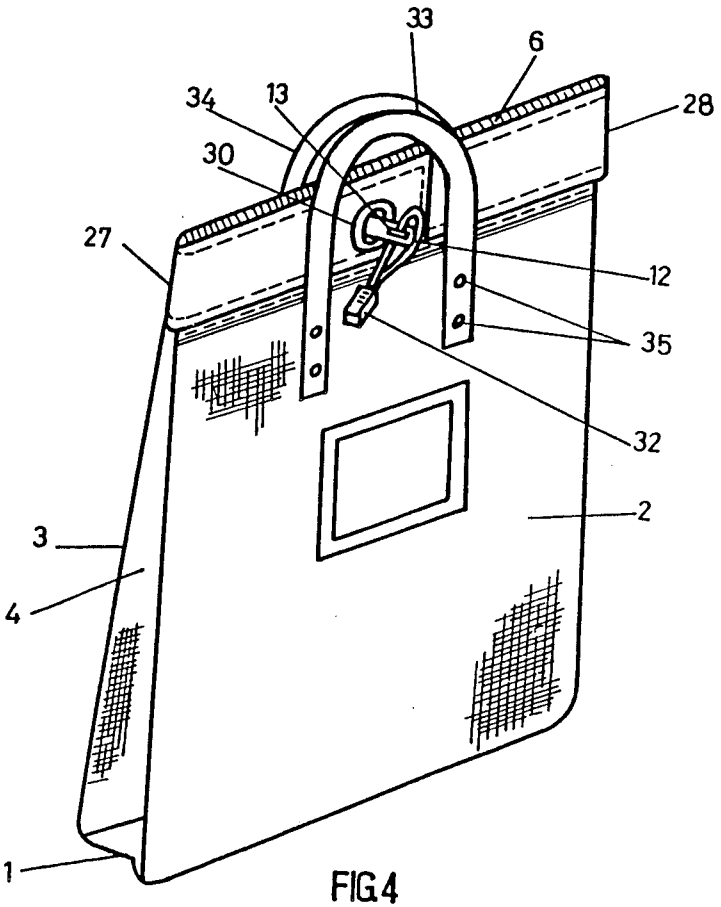
FIG. 4 is a front view, in perspective, illustrating the front of the pouch of FIG. 1 closed, with the safety belt attached.
Figure 3:
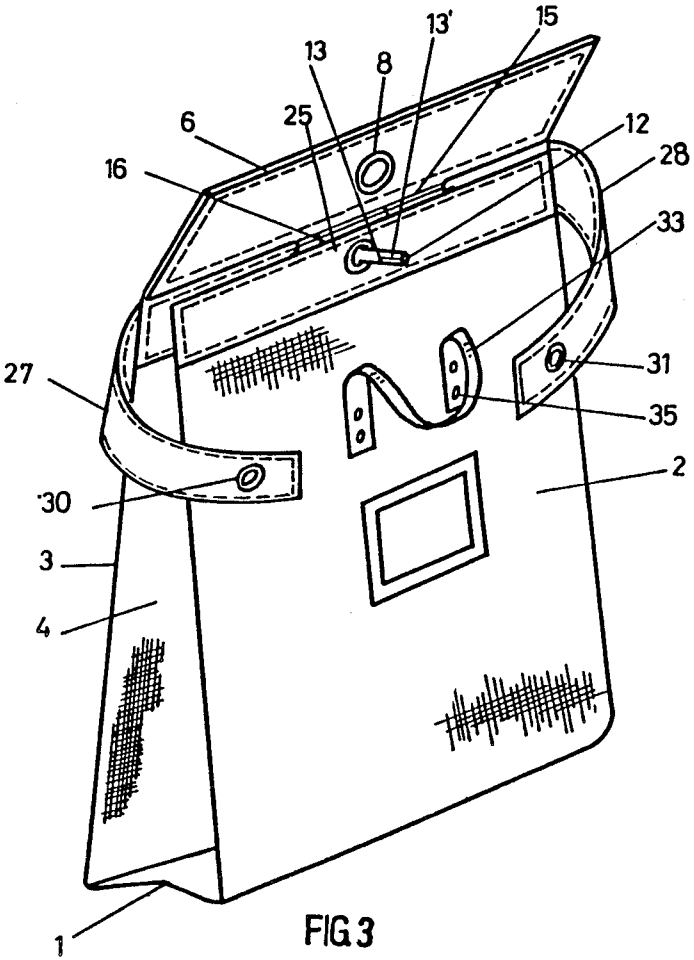
FIG. 3 is a front view, in perspective, of the pouch of FIG. 1 illustrating the two side walls and the front wall of the pouch in closed relationship and with the eyelet opening therethrough mounted about a bolt member and the top flap and the two strips or belts in a position to do so.
Figure 6:
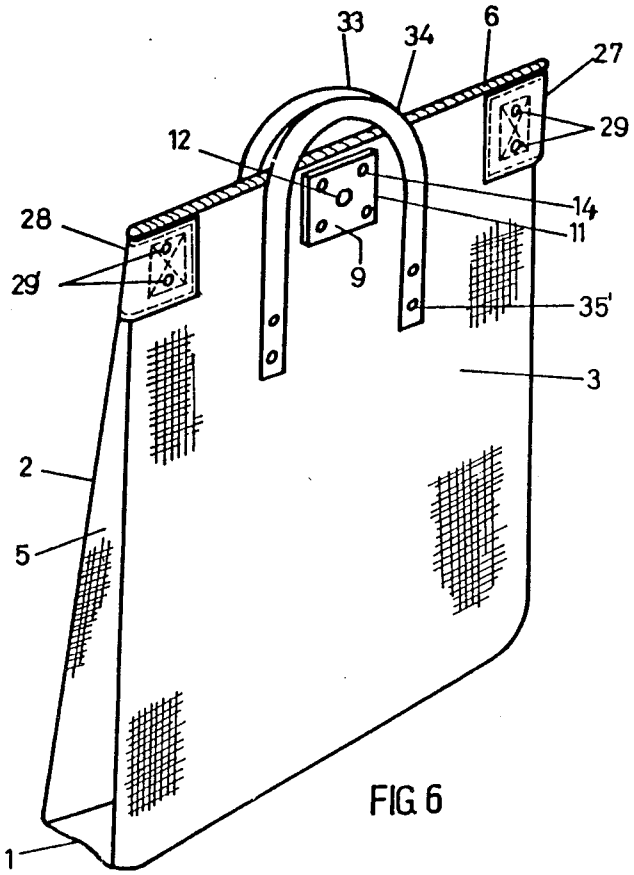
FIGS. 5 and 6 are a back view, in perspective, of the pouch of FIG. 1.
Figure 5:
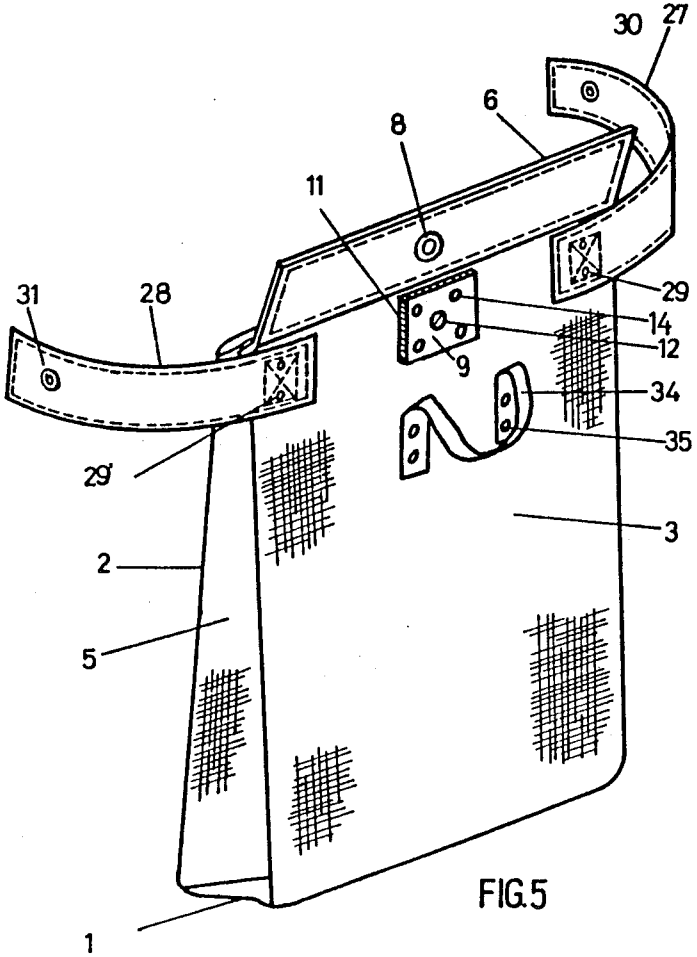

Flap 6, in a bending action which produces a radial displacement movement, overlaps the top of front wall 2 and faces bolt 12 which pierces it through opening 8. The locking system is completed by two strips or belts 27 and 28 secured at one end to the back wall 3 in the area below flap 6 and projecting longitudinally towards side walls 4 and 5. Belts 27 and 28 are attached to the back wall 3 by four rivets 28 and 29', and has openings 30 and 31 respectively near the projecting end, formed by eyelets. These strips or belts 27 and 28 are long enough to surround, close and press in the upper edges of sidewalls 4 and 5 when they are extended forcibly to enfold the top of front wall 2 and mount openings 30 and 31 therethrough on the grooved bolt 12. Upon accommodating through its opening 13 the safety belt 32 (FIG. 4), bolt 12 retrains parts 2, 3, 4, 5, 6, 27 and 28 in juxtaposition, with the rigid parts 7, 15, 16 and 26 all being pierced by bolt 12, forming a compact block, squeezed together, in which there are no gaps nor can the fabric form wrinkles or be displaced, which is the main inducement for stealing. The pouch is opened by cutting the safety belt 32, loosening strips 27 and 28 and then lifting flap 6 which automatically opens the mouth 40 of the pouch 1 and shapes it into a parallelogram by gravity, which displaces front wall 2 and aligns the sidewalls 4 and 5, as the rigid parts 15, 16, 17 and 18 are expandedly reoriented between back wall 3 and front wall 2.

Figure 9:
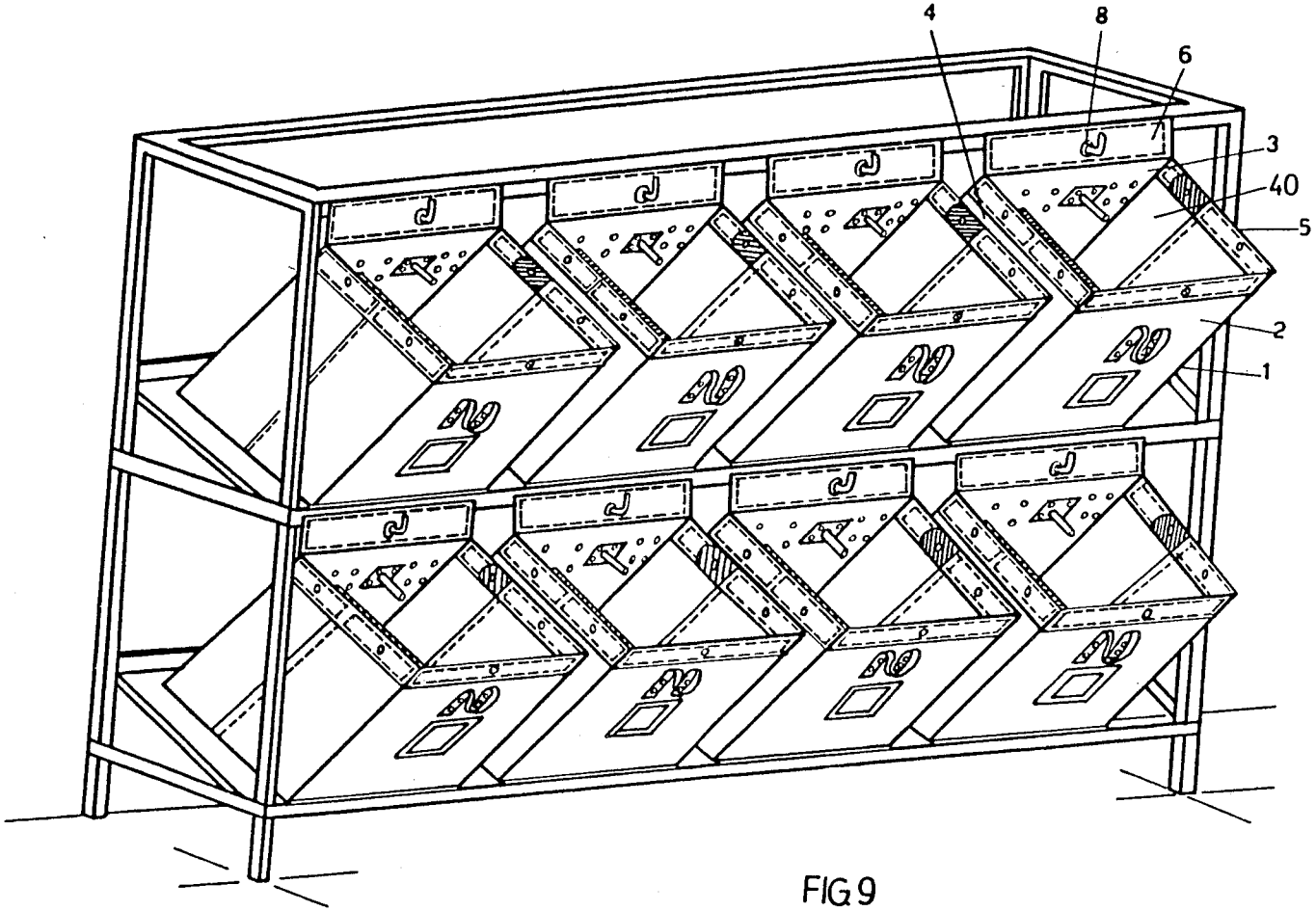
FIG. 9 is a front view, in perspective, of a plurality of pouches of FIG. 1 hung on hooks after the belts and flaps are loosened to form a receiving battery thereof.

The pouch may be put on a hook through opening 8, as shown in FIG. 9, which illustrates the advantage of the design of the open mouth in the shape of a parallogram and its natural incline achieved automatically by gravity, greatly speeding up packing for shipment, which is generally subject to a very strict schedule. The pouch has two handles 33 and 34 for carrying it, attached on back wall 3 and front wall 2, respectively, by rivets 35 and 35'.

In addition to all the foregoing, it must be expected that further modifications of construction details will be made which may not deviate from the limits and purpose indicated for the invention in the following claims:

What is claimed is:

1. A pouch for valuables having a safety lock comprising:

a pouch with an openable mouth having a back wall, an opposite front wall and two opposing articulated side walls extending therebetween with at least the top portions of said side walls adjacent the mouth defining ends thereof having rigid support members secured thereto;

said back wall having one end of an inwardly extending bolt member secured to an upper portion thereof, an opposite inwardly extending end of said bolt member having means to accommodate locking means, and said back wall having a rigid flap member extending from a top portion thereof and two longitudinal extensions extending laterally from opposite sides of the upper portion of said back wall, said flap member having an opening therethrough and being disposed to extend over the mouth and front wall of said pouch with the opening therethrough receiving said bolt member and each of said longitudinal extensions having an opening through an end thereof and being disposed to enfold over the side walls and front wall with the openings therethrough receiving said bolt member;

said opposite front wall having an opening therethrough in an upper portion thereof being disposed to receive said bolt member;

and said articulated side walls being arranged as inwardly extending lateral pleats with an opening in the rigid support members secured to each of said side walls being disposed to receive said inwardly extending bolt member;

whereby upon closing the mouth of said pouch, the articulated side walls are arranged as inwardly extending pleats with the openings in the rigid support members being pierced by said bolt member, the opening in the front wall being pierced by said bolt member, the rigid flap member being enfolded over the mouth and front wall with the bolt member piercing the opening, the longitudinal extensions being enfolded about the side walls and front wall with the bolt member piercing the opening therethrough and thereby all the parts defining the openable mouth are squeezed and confined by virtue of the rigidity and juxtaposition thereof when they are pierced by said bolt member and locking means is mounted thereon.

2. The pouch for valuables according to claim 1, wherein the mouth opens automatically, and the sides automatically unfold when the flap member and longitudinal extensions are removed from the bolt member.

3. The pouch for valuables according to claim 1, wherein all the parts which make up the locking system are confined by a single bolt piercing member.

4. A pouch for valuables according to claim 1, wherein a rigid support member is secured to an upper portion of said front wall which accommodates said opening therethrough.

5. A safety lock for a puch for valuables having an openable mouth, and a front wall, a back wall and opposing articulated side walls extending therebetween which define the mouth of said pouch which comprises: an inwardly extending bolt member secured at one end to an upper portion of the back wall with an opposite end thereof having means to accommodate locking means; rigid support members secured to a top portion of said side walls, said support members having openings therethrough disposed to receive said bolt member; an opening in the front wall being disposed to receive said bolt member; a rigid flap member with an opening therethrough extending from a top portion of said back wall being disposed to extend over the mouth and a portion of the front wall of said pouch and to receive said bolt member through the opening therethrough and two longitudinal extensions laterally extending from opposite upper side portions of said back wall with an opening through an end of each of said extensions, said extensions being disposed to extend about said said walls and a portion of said front wall and to receive said bolt member; a lock being provided for the openable mouth of said pouch by virtue of said rigid support members secured to said side walls, said front wall, said rigid flap member enfolding the mouth and a portion of the front wall and said longitudinal extensions enfolding said side walls and a portion of said front wall being pierced by said bolt member and locking means being mounted on the end of said bolt member.

6. A safety lock according to claim 5, which includes a rigid support member being secured to an upper portion of said front wall which accommodates the opening therethrough.

7. A safety lock according to claim 6 wherein said bolt member has a transversely extending opening therethrough for accommodating said locking means.

8. A pouch according to claim 1, including locking means mounted on the end of said bolt member.

9. A pouch according to claim 1, wherein said openable mouth assumes a substantially parallelogram shape when open.

* * * * *

UNITED STATES PATENT AND TRADEMARK OFFICE

CERTIFICATE OF CORRECTION

PATENT NO. : 4,783,978

DATED : November 15, 1988

INVENTOR(S) : Jose A. Vallerga

It is certified that error appears in the above—identified patent and that said Letters Patent is hereby corrected as shown below:

Claim 5. Line 17 should read -

A safety lock for a pouch for valuables...

Line 36 should read - said extensions being disposed to extend about said side...

Signed and Sealed this

Second Day of May, 1989

*Attest:*

DONALD J. QUIGG

*Attesting Officer*

*Commissioner of Patents and Trademarks*